United States Patent [19]

Desogus

[11] Patent Number: 4,612,951

[45] Date of Patent: Sep. 23, 1986

[54] WATER-STORAGE RESERVOIR

[76] Inventor: Fabio Desogus, 09100 Cagliari, (Pirri) Sardegna, Italy

[21] Appl. No.: 753,073

[22] Filed: Jul. 9, 1985

[30] Foreign Application Priority Data

Jul. 13, 1984 [IT] Italy ..... 48563 A/84

[51] Int. Cl.[4] ..... E03B 11/14; B67D 5/54

[52] U.S. Cl. ..... 137/209; 137/571; 137/574; 137/576; 137/577

[58] Field of Search ..... 137/209, 571, 574, 576, 137/577; 138/30

[56] References Cited

U.S. PATENT DOCUMENTS

| | | | |
|---|---|---|---|
| 308,563 | 11/1884 | Kauke | 137/209 |
| 323,851 | 8/1885 | Butler | 137/209 |
| 992,802 | 5/1911 | Purdy | 137/571 |
| 1,230.028 | 6/1917 | Rardon | 137/209 |
| 1,486,533 | 3/1924 | Moffly | 137/209 |
| 1,514,698 | 11/1924 | Hampton | 137/571 |
| 1,746,186 | 2/1930 | Bramwell | 137/209 |
| 2,322,729 | 6/1943 | Holman | 137/209 |
| 3,527,243 | 9/1970 | Montag | 137/209 |
| 4,185,414 | 1/1980 | Miller | 137/577 |

FOREIGN PATENT DOCUMENTS

| | | | |
|---|---|---|---|
| 2847845 | 5/1979 | Fed. Rep. of Germany | 137/576 |

*Primary Examiner*—Alan Cohan
*Assistant Examiner*—John A. Rivell
*Attorney, Agent, or Firm*—Beveridge, DeGrandi & Weilacher

[57] ABSTRACT

A water storage reservoir, prevailingly underground, comprising a first reservoir provided above the ground level and connected to water feeding and distribution means, an underground tank which is also connected to said water feeding means, a second reservoir provided inside said tank and on its bottom, and connected to said tank through opening means, the pressure of the water columns in series in the first reservoir and in the tank being always lower than the water feeding pressure.

13 Claims, 4 Drawing Figures

WATER-STORAGE RESERVOIR

DISCLOSURE OF THE INVENTION

The present invention relates to a water storage reservoir. More particularly, the present invention relates to a water storage reservoir, prevailingly underground, having a structure and functional parameters such as to recommend its employment in zones where the seismic risks are very high, or where there are strong winds, or in zones close to airports, in zones where terroristic attempts are frequent, in zones of tourist interest, etc.

As it is well known, water storage reservoirs at the present time are almost all of the hanging type.

It is evident that the employment of reservoirs of such type gives obvious drawbacks in zones of the kind mentioned above. Indeed, the presence of trelliswork or the like for supporting such hanging reservoirs gives remarkable problems of sizing and design that cannot be underestimated in zones that are particularly subject to telluric phenomena or to strong winds.

Moreover, in zones close to airports, reservoirs of such type give quite remarkable problems of maintenance, as said reservoir is required to be clearly visible to airplanes during the landing or take-off.

In addition, reservoirs of the hanging type can be sabotaged very easily, with the deprecable consequences that such occurrence can cause to the collectivity. Moreover, hanging reservoirs lean as a result of ground sags.

A further and last reserve as regards this type or reservoirs is to be made if they are provided near tourist localities, because their external aspect is certainly unpleasant to the sight.

Thus, it is an object of the present invention that of providing a water storage reservoir that does not require supporting structures, does not protrude from the ground level at a large extent, and so it gives no drawbacks in seismic zones or in particularly windy zones.

Moreover, it is an object of the present invention that of providing a water storage reservoir that gives no problems in zones close to airports because of its very low surface protruding from the ground, as well as in tourist zones because the visible surface is lower and more compact.

A further object of the present invention is that of providing a water storage reservoir such that in case of a sabotage it can be restored very easily and with simple carpentry works.

According to the present invention, in order to obtain the objects mentioned above it has been found that a water storage reservoir of the mentioned type can be realized on the basis of three structural members, one of said members being above the ground level and forming the proper water storage reservoir, whereas the two other members are underground and form a tank and a second reservoir inside the tank, with the condition that the pressure of the water columns in series in the first reservoir and in the tank be always lower than the water feeding pressure.

Thus it is a specific object of the present invention that of realizing a water-storage reservoir, prevailingly underground, characterized in that it comprises a first reservoir, provided above the ground level and connected to water feeding and distribution means, an underground tank which is also connected to said water feeding means, a second reservoir provided inside said tank and on the bottom of the same, and connected to said tank through opening means, the pressure of the water columns in series in the first reservoir and in the tank being lower than the water feeding pressure.

According to a particularly preferred embodiment of the present invention, a first pipe is provided connecting the top of said first and said second reservoir, a second pipe whose ends are frustrum-shaped and having upper and lower side feeding holes, said second pipe connecting internally the lower end of the first reservoir with said water distribution means, floating means provided inside said second pipe and closing said upper or lower holes of said second pipe when said first reservoir is respectively full or empty, gate valve means being also provided on said feeding means to the first reservoir and to the tank, on said first pipe, and on said distribution means.

Again according to the reservoir of the present invention, said first and second reservoir as well as said tank are preferably of a cylindrical shape, both said first and second reservoir being made up of metal plate whereas the tank is made up of concrete.

Advantageously the reservoir according to the present invention includes, between said first and said second reservoir, a structure for supporting the weight of the first reservoir.

Again according to the present invention, in the upper part of said first reservoir a previously calibrated valve is preferably provided for damping the water hammer.

Moreover, the water storage reservoir of the present invention advantageously provides an overflow for water level control in the tank.

Finally, according to an embodiment of the reservoir of the present invention, a first reservoir is realized, connected to water feeding and distribution means, as well as a third and a second reservoir, said third reservoir being arranged at the side of said first reservoir or below the same, the second reservoir being connected at the top with the upper part of said first reservoir, and at the bottom with the bottom part of said third reservoir, said second reservoir being provided below both said first and third reservoirs, the pressure of the water columns in series being always lower than the water feeding pressure.

The present invention will be now disclosed, for illustrative and not for limitative purposes, with particular reference to some preferred embodiments illustrated in the Figures of the enclosed drawings wherein.

Figure 1:
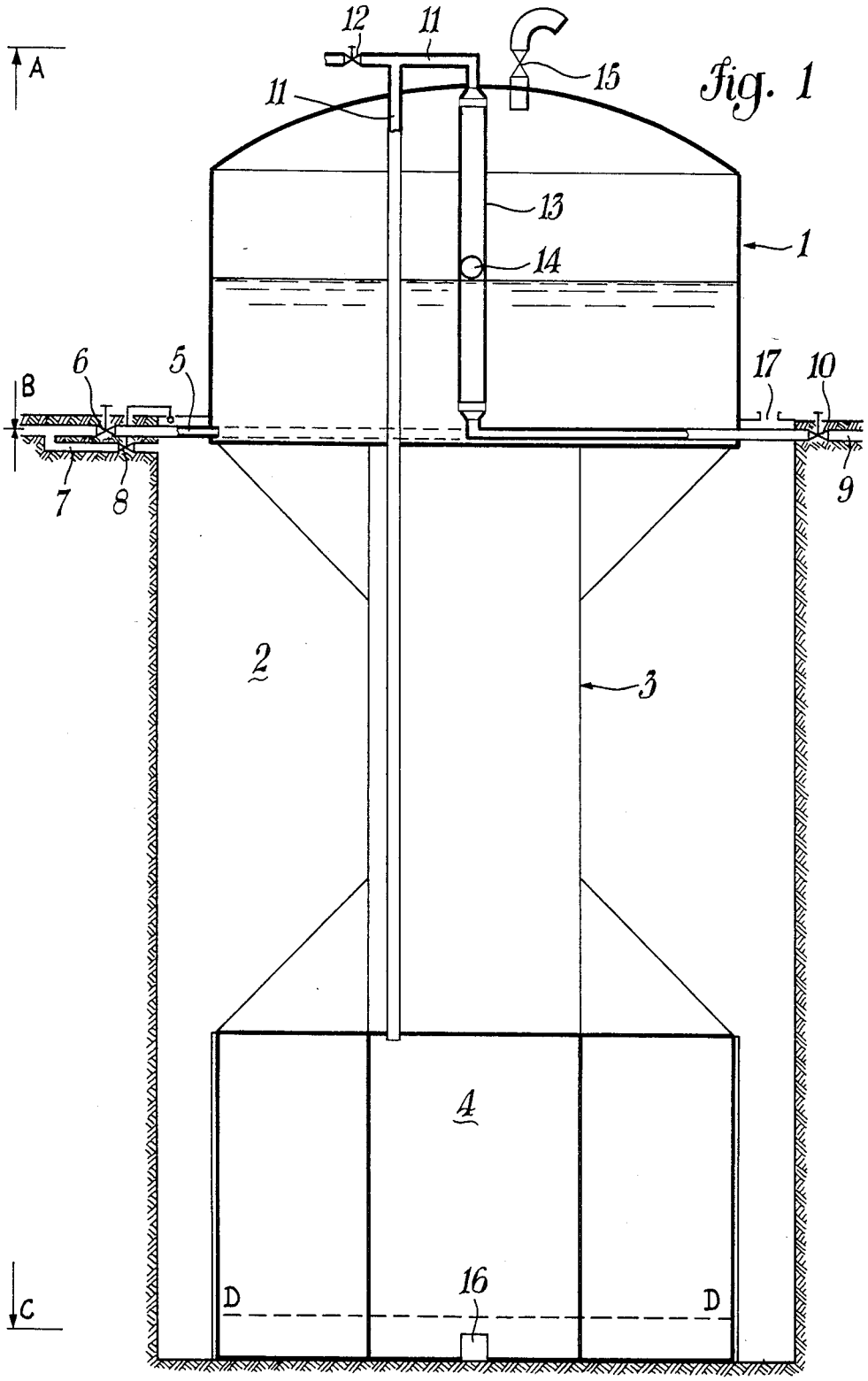
FIG. 1 shows a vertical cross-section of a first embodiment of the reservoir according to the present invention.

As shown in the Figure, the water storage reservoir 1 having the bottom and the top parts joined by tie rods (not shown), prevalently develops along the horizontal direction. Said water storage reservoir 1 rests partly on the circular top of the concrete tank 2 and partly on the base of the reservoir 4 by means of the structure 3.

The water feeding pipe 5 is connected with the base of said reservoir 1, and a gate valve 6 is provided in said pipe. A branch 7 branches off from said pipe 5 upstream of said gate valve 6, said branch connecting the water feeding to the tank 2. A gate valve 8 is provided in said branch 7.

A water outlet pipe 9 is provided on the other side of the reservoir 1 again at it base, the gate valve 10 being mounted in said pipe.

The top of the reservoir 1 and that of the reservoir 4 are connected through the pipe 11, which also includes a gate valve 12. The pipe 11 is connected with the pipe 13, whose ends are frustum shaped and it bears side holes at its upper and lower parts.

A floating 14 is provided inside said pipe 13, the floating closing said pipe in the upper position when the reservoir 1 is full and in the lower position when it is empty.

A previously calibrated valve 15 is provided at the top of the reservoir 1 for the damping of water hammer.

The opening 16 in the lower part of the reservoir 4 connects said reservoir and the tank 2. An overflow 17 is finally provided at the top of the tank 2 for controlling the water level in the same.

To start the operation of the reservoir, in the initial condition both the gate valves 6 and 10 are closed whereas the gate valve 12 is open. The gate valve 12 is opened for filling the tank 2 up to a level such that the empty volume left is equal to that of the reservoir 4 and next the gate valves 8 and 12 are closed.

At that point the gate valve 6 is opened so that the level in the reservoir 1 rises and, because of the small holes provided in the lower part of the pipe 13, the floating 14 also rises, said floating pushing the air above it through the pipe 11 towards the upper part of the reservoir 4.

All that is possible because the whole apparatus has been designed so that the total pressure $p_{AB}+p_{BC}$ is lower than the inlet pressure of the water.

When water is flowed from reservoir 4, whose height and cross-sectional area are equal to those of reservoir 1, through the opening 16, in an amount which is a function of the relation $V=k/p$, the reservoir 1 is completely filled with water and the floating 14 closes the upper holes in the pipe 13 preventing water from passing directly from the feeding pipe 5 of the tank.

Now the previously calibrated valve 15 absorbs the water hammer discharging water and not air.

Next the gate valve 8 opens and it is closed again only after water flows over the point 17. As a result of this last operation and of the preceding one, according to the well known Boyle's law $pV=k$, the water level is higher than point C in the reservoir 4, so that, in order to optimize the system, air is pumped in the pipe 11 through the gate valve 12, letting water to flow over point 17 until air bubbles are seen to go out mixed with water.

At that point, by opening the gate valves 6 and 10 after closing the gate valve 12, water coming directly from the feeding pipe 5 will be supplied to the consumers, as the pressure at which it is fed in is higher than $p_{AC}$, as already mentioned above.

In case the feeding water is lacking, pressure $p_{AC}$ equivalent to the sum of the pressures of the water columns in series in the reservoir 1 and the tank 2 will be of such value as to allow the stock water contained within the reservoir 1 to flow out from the pipe 9.

Practically it is never necessary to exhaust all the stock water, but in such case the floating 14, by closing the lower conical part of the pipe 13, prevents water from coming out the tank 2 as a result of the suction from users.

According to both experiments and theory, the frustum-shaped end can be obtained so that adherence in the closed position is so strong as to make it necessary to connect pipe 5 to pipe 9, below said frustum-shaped end, in order to release the floating 14, when the feeding water is back. All that occurs with no alteration of the operation of the system.

Anyway it is not advisable to lower the level within the reservoir 1 to a very large extent, in order to avoid the double reduction in the pressure due to the lower water column pressure of the reservoir 1 and to the decrease of the water level in the tank 2, which effect is inversely proportional to the cross-sectional area of the tank itself.

It is to be observed that the weight of the whole apparatus keeps substantially unchanged whatever it might be the level in the two reservoir 1 and 4 and that, as the reservoir 4 operates under balanced pressures, building and cost problems are of lower importance.

It is to be understood that the reservoir 1 can also be connected for service to more feeding pipes.

Figure 2:
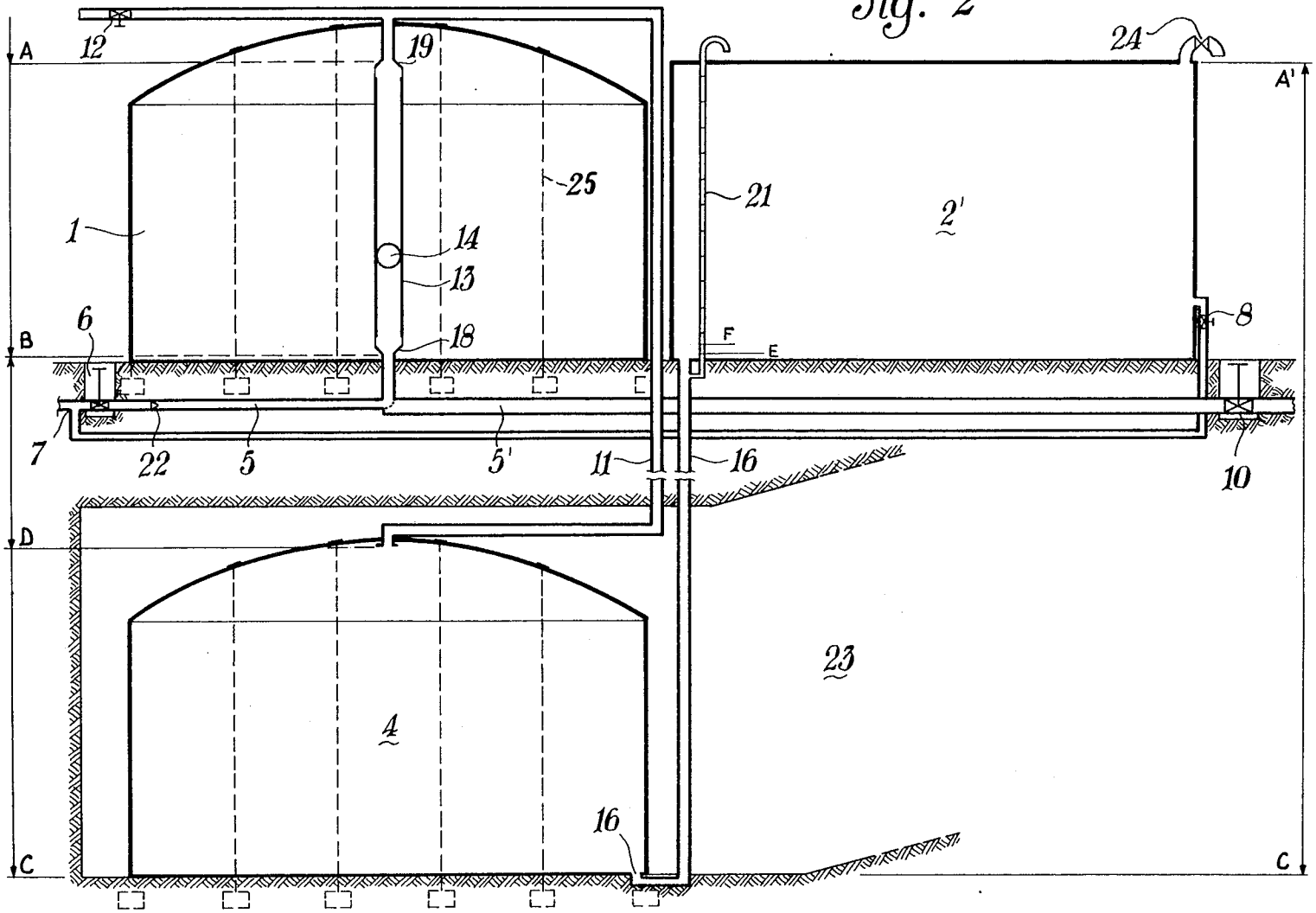
FIG. 2 shows a vertical cross-section of a second embodiment of the reservoir according to the present invention.

According to the reservoir embodiment of the present invention shown in FIG. 2, in which the concept is again present based on the fact that the hydrostatic pressures of two vessels can be summed by interposing air in series at the maximum pressure of the open top vessel, the structure 3 of FIG. 1 is eliminated and the tank 2 is replaced by the reservoir 2' arranged at the side of the reservoir 1.

The reservoirs 1 and 2' can be arranged either at the ground level or underground, when space is to be saved, whereas the reservoir 4 is arranged below reservoirs 1 and 2', at the end of a tunnel 23 bored purposely. Tie rods 25 are provided on reservoir 1 to increase the strength of the reservoir.

Initially the gate valves 12 and 8 are opened, the gate valve 8 being closed again when water from the feeding pipes 5 and 5', after filling the reservoir 4 into which it comes passing through the bottom of the reservoir 2' and through the pipe 16, has reached the level B within the pipe 11, said level corresponding to the letter E of the gauge 21.

The gate valve 12 will be closed when water has reached level D in the pipe 11 and level F in the reservoir 2' as a result of the pressure of the air pumped through the valve itself.

The pneumatic pressure given by the hydrostatic pressure $p_{FD}$ is conserved within the reservoir 1, such pressure being the minimum value available to the users.

Under such conditions, by opening the gate valve 6 the operation will be similar to the disclosed previously with respect to the embodiment of FIG. 1, except for the fact that water flowing out from the reservoir 4 collects within the reservoir 2' and the total maximum pressure available will be $P_{A'C}+p_{AB}$.

In case of peak rate of flow demand, the stock water is in parallel to the normal feeding so that a double delivery is possible.

It can be observed that in this instance the end 19 of the pipe 11 is lowered into the reservoir 1 so as to increase the air pocket and so that the water level is more free to expand towards the top on increasing, at the closing moment, and the water hammer is avoided so that the presence of valve 15 of FIG. 1 becomes unnecessary.

Such a solution can be clearly adapted to the embodiment illustrated in FIG. 1.

The embodiment of FIG. 2 according to the present invention can be employed for home uses arranging the reservoirs 1 and 2' below the ceiling or above it in case of cottages or of top floors, and the reservoir 4 on the floor. The reservoir 2' can also be arranged below the reservoir 1 in the form of a column. To that aim, the pipe 5' and the gate valve 10 become unnecessary and it is sufficient to joint the pipe 7 to a plug of the waterworks, placing the outlet valve 22 on the meter.

Figures 3, 4:
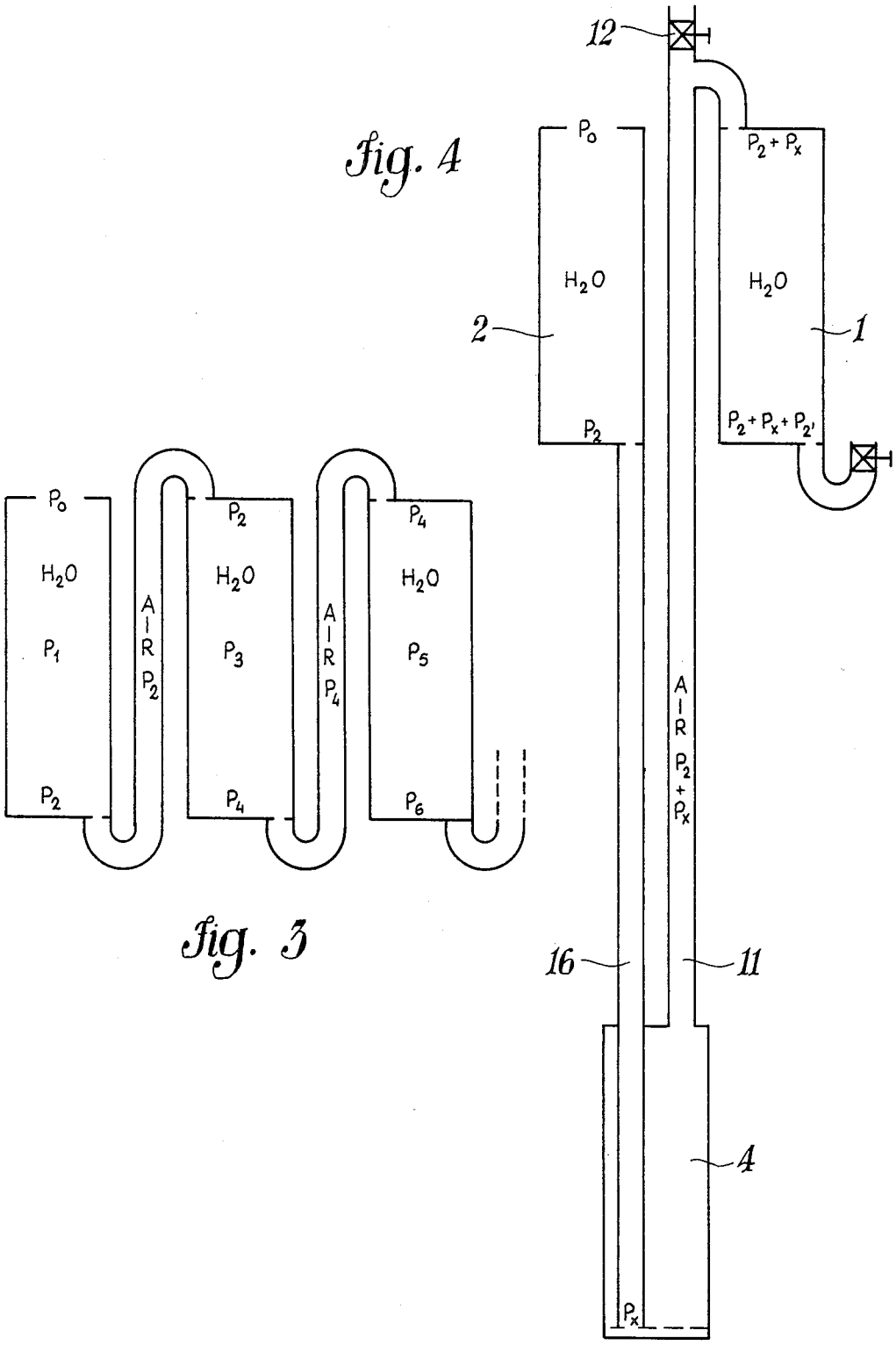
FIGS. 3 and 4 illustrate schematically the concept on which the various embodiments of the present invention are based.

FIGS. 3 and 4 help to understand better the principle on which the reservoir according to the present invention is based.

More particularly, it can be observed that starting with a first open-top vessel or reservoir, the pressures of a number of vessels or reservoirs can be summed, even though said reservoirs are at reciprocally different levels, on condition that the communication means between said vessels or reservoirs contains air at the maximum pressure of the preceding vessel or reservoir.

The present invention has been disclosed with particular reference to some of its preferred embodiments, but it is to be understood that modifications and changes can be introduced by those who are skilled in the art without departing from the scope of the present invention.

I claim:

1. A water-storage reservoir, prevailingly underground, comprising a first reservoir provided above the ground level and connected to water feeding and distribution means, an underground tank which is also connected to said water feeding means, a second reservoir provided inside said tank and on the bottom of the same and connected to said tank through opening means, a first pipe connecting the tops of said first and second reservoirs, a second pipe whose ends have a frustum shape and having upper and lower side feeding holes, said second pipe connecting internally the lower end of the first reservoir with said water distribution means, floating means provided inside said second pipe for closing said upper or lower holes of said second pipe when said first reservoir is respectively full or empty, and gate valve means provided on said feeding means to the first reservoir and to the tank, as well as on said first pipe and said distribution means, the pressure of the water columns in series in the first reservoir and second reservoir and in said tank by means of said first and second pipe and of said opening means always being lower then the water feeding pressure.

2. A water storage reservoir according to claim 1, characterized in that said first and second reservoirs are of cylindrical shape, said first and second reservoirs being made up of metal plate whereas said tank is made up of concrete.

3. A water storage reservoir according to claim 1, characterized in that tie rods are provided on said first reservoir in order to increase its strength.

4. A water storage reservoir according to claim 1 characterized in that a structure is provided between said first and second reservoir supporting the weight of the first reservoir.

5. A water storage reservoir according to claim 1, characterized in that a previously calibrated valve is provided above said first reservoir for damping the water hammer.

6. A water storage reservoir according to claim 1, characterized in that an overflow is provided for controlling the water level within the tank.

7. A water storage reservoir according to claim 1, wherein an overflow is provided for controlling water level within the tank.

8. A water storage reservoir characterized in that it comprises a first reservoir connected to said water feeding and distribution means, a third reservoir arranged at the side of said first reservoir or below the same, a second reservoir connected at the upper part to the top of said first reservoir and, at the lower part, to the bottom of said third reservoir, and provided below both said first and third reservoirs, the pressure of the water columns in series being always lower than the water feeding pressure.

9. A water storage reservoir according to claim 8, which comprises a first pipe connecting the tops of said first and second reservoirs, a second pipe whose ends have a frustum shape and having upper and lower side feeding holes said second pipe connecting internally the lower end of the first reservoir with said distribution means of water, floating means provided inside said second piping means, that close said upper or lower holes of said second pipe when said first reservoir is respectively full or empty, and gate valve means provided on said feeding means of the first reservoir and of the third reservoir, as well as on said first pipe and said distribution means.

10. A water-storage reservoir according to claim 3, in which said first and second reservoirs are of cylindrical shape, said first and second reservoirs are comprised of metal plate and said tank is comprised of concrete.

11. A water storage reservoir according to claim 2, wherein said first and second reservoirs are of cylindrical shape, said first and second reservoirs being comprised of metal plate, whereas said third reservoir is comprised of concrete.

12. A water storage reservoir according of claim 2, wherein tie rods are provided on said first reservoir in order to increase its strength.

13. A water storage reservoir according to claim 2, wherein a previously calibrated valve is provided above said first reservoir for damping water hammer.

* * * * *